350-361 SR
10/21/80 OR 4,229,081

United States Patent [19]

Jones et al.

[11] 4,229,081

[45] Oct. 21, 1980

[54] ELECTRO-MECHANICAL IMAGE CONVERTER

[75] Inventors: Terry L. Jones, Springfield; Brian S. Miller, Alexandria, both of Va.

[73] Assignee: The United States of America as represented by the Secretary of the Army, Washington, D.C.

[21] Appl. No.: 919,182

[22] Filed: Jun. 26, 1978

[51] Int. Cl.[3] ..... H01J 29/70

[52] U.S. Cl. ..... 350/361; 350/269; 350/285

[58] Field of Search ..... 350/266, 269, 285, 359, 350/360, 361

[56] References Cited

U.S. PATENT DOCUMENTS

| | | | |
|---|---|---|---|
| 3,667,830 | 6/1972 | Rottmiller | 350/361 |
| 3,746,911 | 7/1973 | Nathanson et al. | 350/361 |
| 3,886,310 | 5/1975 | Goldberg et al. | 350/360 |

*Primary Examiner*—William L. Sikes

*Attorney, Agent, or Firm*—Nathan Edelberg; Robert P. Gibson; Aubrey J. Dunn

[57] ABSTRACT

A two-dimensional array of small, thin, flexible, metalized mirrors are mounted atop supports on one side of a photoelectric layer. A visible light or infrared image on the other side of the layer induces an electron image (charge pattern) beneath the mirrors. The mirrors deflect towards the layer in accordance with the charge pattern. Light projected onto the mirrors is reflected and forms an image dependent on the deflections thereof.

1 Claim, 1 Drawing Figure

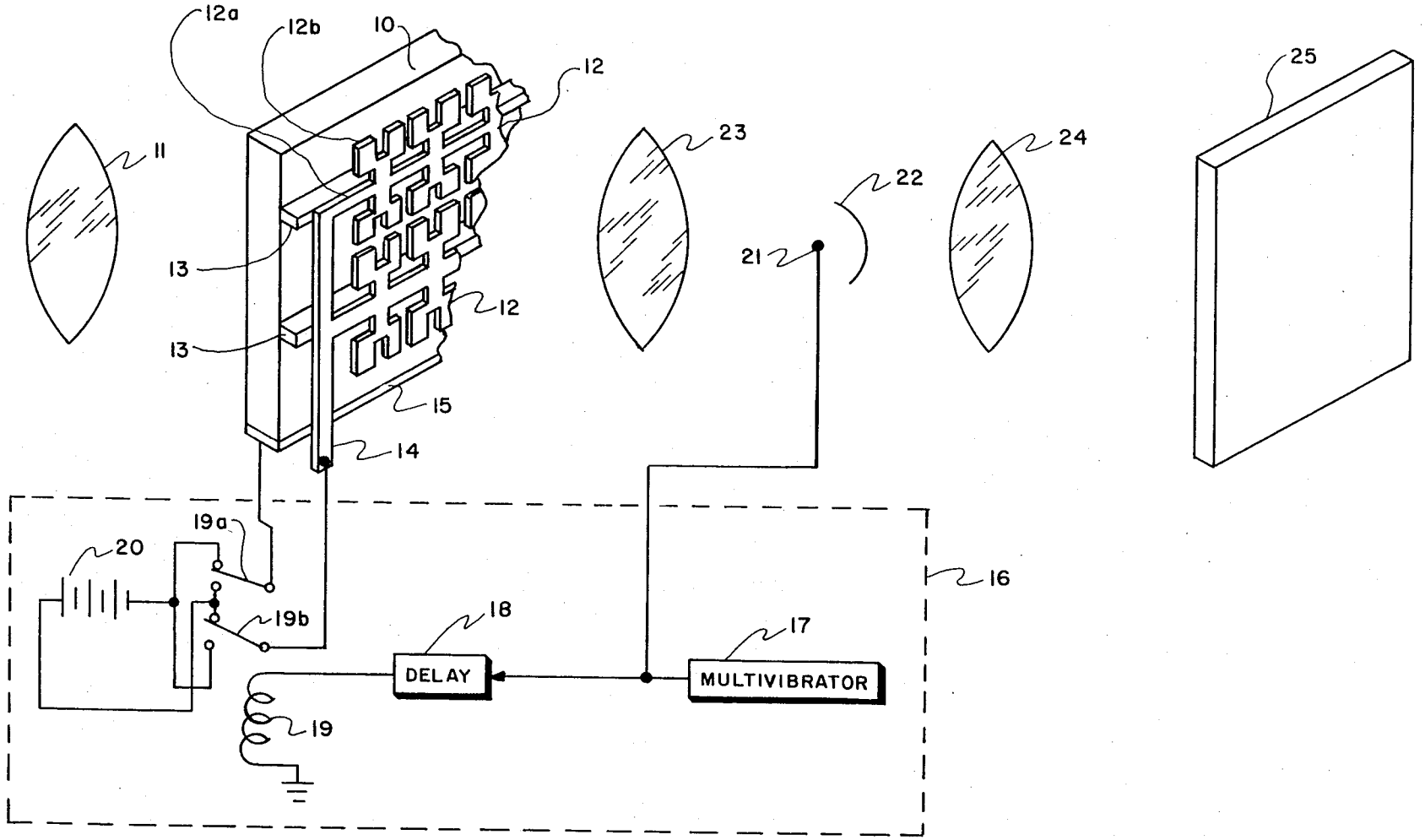
25
24
22
21
23
12
12
10
12b
12a
11
13
13
15
14
16
17
MULTIVIBRATOR
18
DELAY
19
19a
19b
20

ELECTRO-MECHANICAL IMAGE CONVERTER

The invention described herein may be manufactured, used, and licensed by the U.S. Government for governmental purposes without the payment of any royalties thereon.

BACKGROUND OF THE INVENTION

This invention is in the field of image converters, and particularly those converters for producing visible images from lower level visible images (image intensifiers) or from infrared images. Such converters usually include photo-electric layers having low level visible or infrared image sides and electron image side. The electron image (charge patterns) may be intensified by such means as microchannel plates. In any event, electrons are eventually used to bombard and excite a phosphor to produce a visible image. The problem with such converters is that it is difficult in practice to obtain high brightness and high contrast visible images. Such images are necessary if one desires to directly view or to project an image onto a screen or the like. Our invention is able to produce an image capable of being directly viewed or projected but not depending upon a phosphor to produce an image. Instead of a phosphor we incorporate into our invention a light valve projection system as shown in U.S. Pat. Nos. 3,746,911 and 3,886,310. Another system using the equivalent of light valves is that shown in U.S. Pat. No. 3,667,830.

SUMMARY OF THE INVENTION

Our invention is an electro-mechanical image converter including a photo-electric layer for producing an electron image (charge pattern) from a photon image. On the charge pattern side of the layer we have an array of small metalized light reflectors. Each reflector is flexible and bends toward the layer in accordance with the charge on the layer beneath the reflector. Light projected onto the array is reflected and formed into an image dependent on the charge pattern of the photoelectric layer.

BRIEF DESCRIPTION OF THE DRAWINGS

The single drawing FIGURE is a schematic showing of the invention.

DETAILED DESCRIPTION OF THE INVENTION

The invention may perhaps be best understood by referring to the drawing, in which element 10 is a photoelectric layer of p-type silicon. On one side of 10 is objective lens 11 for forming an image of a far infrared or low-level visible scene onto 10. This image may be called a photon image. On the opposite side of 10 is a light-valve array consisting of parallel reflector assemblies 12 carried by insulating walls 13. Layer 10 responds to photon images thereon to produce an electron image (charge pattern) beneath the reflector assemblies. Each reflector assembly is metalized plastic or the equivalent and includes a stem 12*a* and leaves 12*b* on either side of the stem. One end of each 12*a* is connected to a common conductor 14. Layer 10 has ohmic contact 15 on its edge.

A readout means 16 has electrical conductors connected to conductor 14 and contact 15. This readout means, as an example, may include multivibrator 17, delay line (or equivalent) 18, relay 19, and power source 10. Relay 19 includes double-pole, double-throw contacts 19*a*/19*b*. The output of multivibrator 17 feeds both delay line 18 and light source 21 with reflector 22. Lenses 23 and 24 serve as projection lenses for light emitted by source 21 and reflected from reflector assemblies 12. An electron image on layer 10 can be produced as a visible image on screen 25, as will be explained below

OPERATION

As mentioned above, a photon image on one side of 10 will induce a charge pattern on the other side. With the contacts of relay 19 as shown, battery 20 will apply a potential to reflector assemblies 12. This potential causes an individual reflector leaf 12*b* to deflect toward 10 in accordance with the charge beneath that leaf. The leaves will thus be deflected in a pattern dependent upon the photon image on 10. This pattern may be used to produce a visible image on screen 25 by way of light 21.

When multivibrator 17 produces an output pulse, light 21 is turned on and floods the array of reflector assemblies 12 with a short read pulse of visible light. For undeflected leaves 12*b*, this light is merely reflected back to 21. However, for deflected leaves, the light will pass back through lens 23 to lens 24 and thence to screen 25 in the manner as taught in U.S. Pat. No. 3,886,310. Screen 25 will thus show an image representative of the input photon image on layer 10. Alternately, lens 24 may be an eyepiece for direct viewing. The output pulse from 17, after delay through delay line 18 will cause contacts 19*a*/19*b* of relay 19 to operate to their alternate positions and to reverse the potential between 10 and the reflector array. This reversal effectively erases the electron image on 10 and resets 10 for a new image.

Although we have described as specific contents for our readout means 16, obviously other elements are capable of performing the same functions, the only requirements being a read pulse and a reset pulse. If desired, 21 may be pulsed at a television or other frame rate to provide a real-time moving image or at a much slower rate to provide image integration. Moreover, delay 18 may not be needed if the read pulse (and erase pulse) are of sufficient shortness with respect to the response time of the leaves.

Moreover, readout of the electron image may be accomplished in an entirely different manner from that so far disclosed. Specifically, for light 21 we may substitute a pulsed laser or other light capable of providing a narrow beam. This beam may be swept in a raster pattern as it is pulsed, to fall on only reflective leaves 12*b*. Also, the beam may be swept and pulsed at rates compatable with television rates, if desired. It can also be used as an input channel for other than uniform illumination to modify the output image by an additional information source.

The particular shapes of individual leaves 12*b* is not critical, nor is the orientation of reflector assemblies 12. However, reflector 22 must have a shape and orientation corresponding to any particular leaf shape and assembly orientation. Moreover, although the leaves have been described as metalized plastic, they may be made of metal, but with a reduced life expectancy, since metals do not have the long-term elasticities of long chain polymers such as plastics. If necessary, the response time of the leaves may be lengthened with a film of dielectric liquid, such as water.

Layer 10, although described as being p-type silicon, may also be n-type, with battery 20 reversed from the connection shown. As a matter of fact, 10 may be chosen from any of those materials having an appropriate band-gap for the wavelength of interest. The materials include p and n-type germanium, lead tin telluride, etc.

We claim:

1. An electro-mechanical image converter including:

a photoelectric layer having essentially planer and parallel photon-image and electron-image sides;

an array of deformable, light-reflective elements on said electron-image side of said photoelectric layer, wherein said elements each include an insulating support with one end on said electron-image side of said layer and with at least a thin metallic leaf on the other end;

means for establishing a voltage potential between said layer and said array and whereby a photon image on the photon-image layer induces an electron image on the photon-image side thereof and further whereby said elements deflect toward said electron-image side of said layer in accordance with the electron image thereon;

a light source;

means for projecting said light from said light source onto said elements and for forming an image of light reflected therefrom; and means for reversing said voltage potential whereby said elements of said array return to their undeflected positions.

* * * * *